United States Patent [19]

Lange et al.

[11] 4,305,325

[45] Dec. 15, 1981

[54] GENERAL PURPOSE DECOY LAUNCHER

[75] Inventors: Robert G. Lange, Olney, Md.; Lawrence P. Dorsett, Johns Island, S.C.

[73] Assignee: The United States of America as represented by the Secretary of the Navy, Washington, D.C.

[21] Appl. No.: 89,784

[22] Filed: Oct. 31, 1979

[51] Int. Cl.[3] ..... F41F 3/04

[52] U.S. Cl. ..... 89/1.815; 89/41 M; 89/1.816

[58] Field of Search ..... 89/1.815, 1.816, 1.819, 89/1.8, 1 E, 1 L, 1.5 R, 41 D, 41 M, 41 R; 102/89 CD

[56] References Cited

U.S. PATENT DOCUMENTS

| | | | |
|---|---|---|---|
| 2,977,851 | 4/1961 | Hersh et al. | 89/1.815 X |
| 2,985,072 | 5/1961 | Carlberg et al. | 89/1.802 |
| 3,106,132 | 10/1963 | Biermann et al. | 89/1.815 |
| 3,166,975 | 1/1965 | Landstrom et al. | 89/1.802 |
| 3,316,809 | 5/1967 | Riedel | 89/1.815 |
| 3,331,279 | 7/1967 | Aldrin et al. | 89/1.815 X |
| 3,446,112 | 5/1969 | Planitzer et al. | 89/1.815 |
| 3,865,009 | 2/1975 | Kongelbeck | 89/41 D X |
| 4,144,797 | 3/1979 | Berge et al. | 89/41 M |

*Primary Examiner*—David H. Brown

*Attorney, Agent, or Firm*—R. S. Sciascia; A. L. Branning; J. C. LaPrade

[57] ABSTRACT

A general purpose decoy launcher comprising two concentric cylinders and having a launch platform attached to the inner cylinder by a load bearing hinge. The muzzle portion of the launch platform is attached to one end of an elevating mechanism, the other end of which rides in an inclined surface fabricated as part of the outer cylinder. Motion of the launcher to and from the firing configuration is accomplished by the holding of the outer cylinder stationary while rotating the inner cylinder with respect to it. Relative motion between the cylinders causes the elevating mechanism to rise on the inclined surface, thus elevating the launch platform to the firing angle. Launching tubes are located within the confines of the launching platform.

18 Claims, 5 Drawing Figures

LOAD POSITION

FIRE POSITION

GENERAL PURPOSE DECOY LAUNCHER

BACKGROUND OF THE INVENTION

The present invention relates generally to improvements in military decoy systems, and more particularly pertains to a new and improved decoy launcher wherein a pair of concentric cylinders moveable relative to each other are utilized to elevate and train the launcher's firing table.

Decoy systems now comprise an essential part of each ship's anti-ship missile defense (ASMD). The Rapid-bloom Off-board Chaff (RBOC) and Super Rapid-bloom Off-board Chaff (SRBOC) systems are presently installed on board many ships and current developments will likely provide the Torch, Sea Gnat, and Active Electronics Decoy (AED) rounds in the near future. These decoys provide an effective defense against anti-ship missile threats presently identified and it may be expected that, as new threats are identified, new decoy rounds will be developed.

While the decoy round itself may be considered the essential component of the system, the effectiveness of the decoy system is critically dependent upon the capability to deliver the round quickly to a specified area with respect to the ship. This is the function of the launching system.

It has been the general practice to equip ships with various chaff dispensing systems. All systems through SRBOC had their own particularly designed launchers, and none of the systems could utilize the launchers of the other systems. With the advent of the SRBOC system, it was decided to make the MK 137 SRBOC launcher the ship's dedicated decoy launcher, and constrain all future decoy rounds so that they would be deliverable by that launcher. Torch, an infra-red decoy, has been designed such that it will be launchable by the MK 137 launcher. Sea Gnat a NATO hybrid decoy, will likely also be launchable from the MK 137 launcher, but with significant contraints on ship attitude at launch or the acceptance of significantly degraded placement accuracy and lengthened deployment time. None of the present AED designs are launchable from the MK 137 launcher nor, given the size required for that particular decoy, is it likely that a design will be developed which will be compatible with the launcher. It is therefore apparent that the prior art MK 137 launcher is not a "universal" decoy launcher and that to attempt to contrain future decoy design to that launcher would be unduly restrictive.

SUMMARY OF THE INVENTION

The general purpose of the present invention is to provide a decoy launcher that is both elevatable and trainable, and which is capable of being utilized to fire all presently known military decoy rounds. To attain this, the present invention provides for a flat launch tube which is horizontal and parallel to the fore and aft axis of the ship in the loading configuration. The launch tube fluctuates to an angle of 20° with the horizontal while swinging perpendicular to the fore and aft axis of the ship in the firing configuration. The launcher comprises two concentric cylinders, and the launch tube is attached to the inner most of the cylinders by means of a load bearing hinge. An elevating mechanism is attached to the muzzle end of the launch tube, and the other end of the elevating mechanism rides in an inclined surface fabricated as part of the outermost cylinder. Movement of the inner cylinder relative to the outer cylinder causes motion of the launcher to and from the firing position. The angle of the inclined surface is chosen so that rotation from the loading to firing configuration provides the optimum launch elevation angle.

It is an object of the present invention to improve the capability of a ship to deliver a decoy projectile quickly to a specified area.

Another object of the present invention is to provide a launch platform which does not impose significant constraints on any particular decoy design.

A further object of the invention is the provision of a highly reliable and easily maintainable launcher.

Still another object is to provide a launcher which requires minimal deck space and personnel to operate.

Other objects and many of the attendant advantages of this invention will be readily appreciated as the same becomes better understood by reference to the following detailed description when considered in connection with the accompanying drawings, in which like reference numerals designate like parts throughout the Figures thereof and wherein.

DESCRIPTION OF THE PREFERRED EMBODIMENTS

Figure 1:
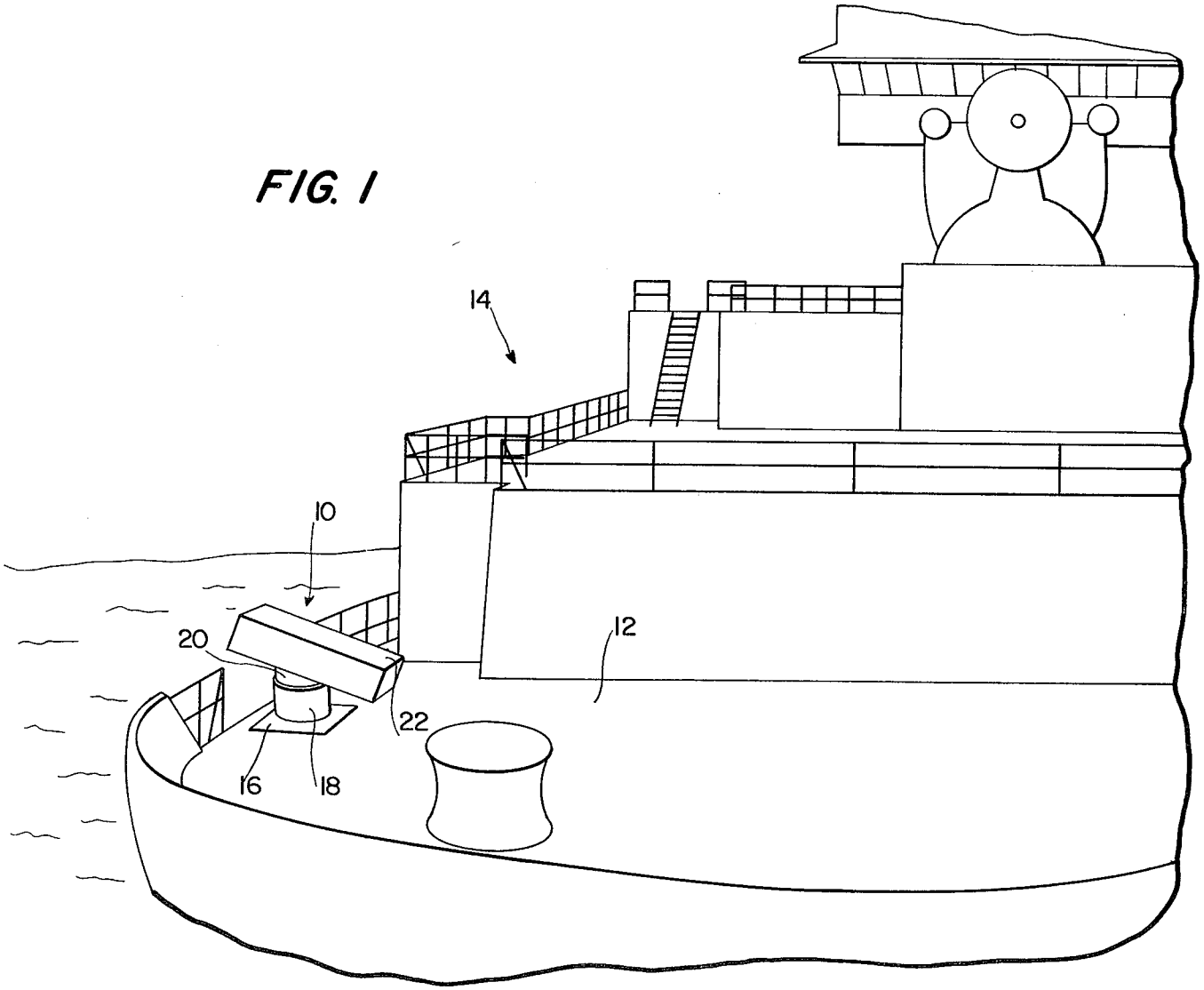
FIG. 1 shows the present invention as it might be typically mounted on a ship.

FIG. 1, which illustrates the preferred embodiment of the present invention, shows a general purpose decoy launcher 10 typically mounted on the deck 12 of a ship 14. As shown, the launcher 10 comprises a base 16 having outer cylinder 18 rotatably mounted thereto. Concentrically mounted to cylinder 18 is inner cylinder 20 upon which is further mounted launch platform 22.

FIG. 1 illustrates that the mounting of the base plate does not occupy much space and is of lesser area than the decoy launcher. The small mounting space and the automatic operation of the electric motors by a computer are advantages in the operation of the decoy launcher that save space and personnel.

Figure 2:
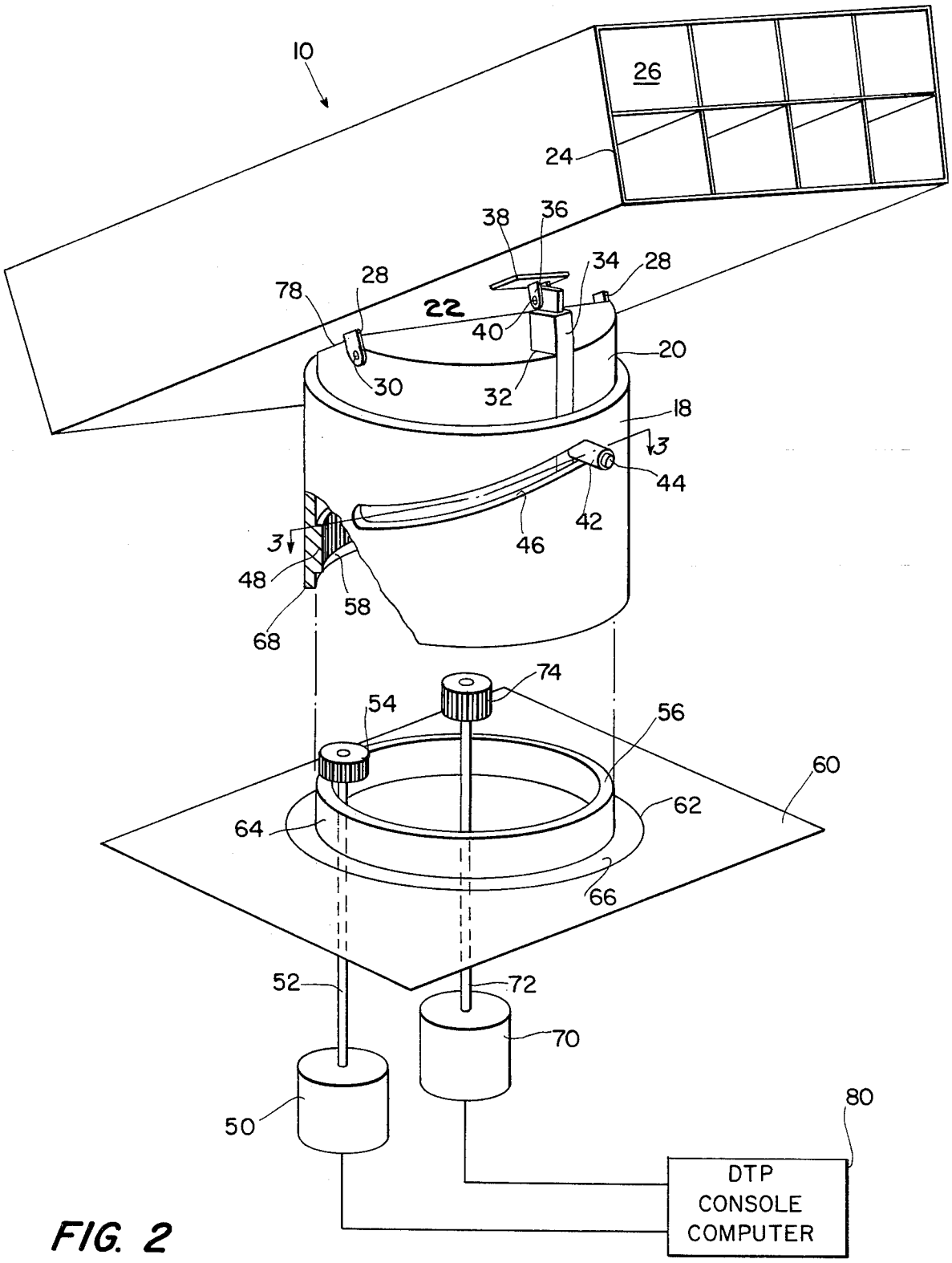
FIG. 2 is a perspective view, partly in section, of the decoy launcher constituting the present invention.

FIG. 2 illustrates the general purpose decoy launcher 10 in greater detail. Specifically, there is shown launch platform 22 having a plurality of decoy launching tubes 24 contained therein. Several decoy rounds 26 are shown positioned within the tubes 24. While in the preferred embodiment only eight decoy launching tubes 24 are shown, it should be recognized that the number of such tubes may vary. Fixably attached to the underside of launch platform 22 are a pair of brackets 28 which are in turn pivotally attached to inner cylinder 20 by means of pivot pins 30. Inner cylinder 20 is concentrically, slidably mounted within outer cylinder 18. An elevating strut 34 is slidably mounted within inner cylinder 20 by means of rectangular slot 32. A narrowed portion 36 of strut 34 is pivotally mounted within strut bracket 38 by means of strut bracket pin 40. Strut bracket 38 is fixably attached to the bottom of launch platform 22. A cam follower shaft 44 is fixably, insertably mounted to elevating strut 34, and a cam follower 42 is rotatably mounted upon the shaft 44. Shaft 44 and the follower 42 mounted thereon is operably contained within an inclined elevation ramp 46 which is cut into the outer cylinder 18. Also shown in FIG. 2 is a circular internal tooth gear 48 which is fixably attached to the inside of the outer cylinder 18. An outer cylinder drive motor 50 having a drive shaft 52 upon which is mounted a drive pinion 54 operably engages internal gear 48 to function as the outer cylinder 18 drive means. A base plate 60 designed to be mounted to the deck 12 of ship 14 has mounted thereon a pair of bearings 56 and 62. Bearing 56 which is cylindrical has an outer bearing surface 64 which operably engages with an inner bearing surface 58 machined into the outer cylinder 18. The second bearing 62 which is located upon plate 60 is also cylindrical and has a bearing surface 66 which operably abuts bearing surface 68 located on the bottom of outer cylinder 18. Bearings 56, 62 permit the rotation of cylinder 18, and thus the launcher 10, about base plate 60. A second drive motor 70, having drive shaft 72 and drive pinion 74, is utilized to rotate the inner cylinder 20 relative to the outer cylinder 18.

Figure 3:
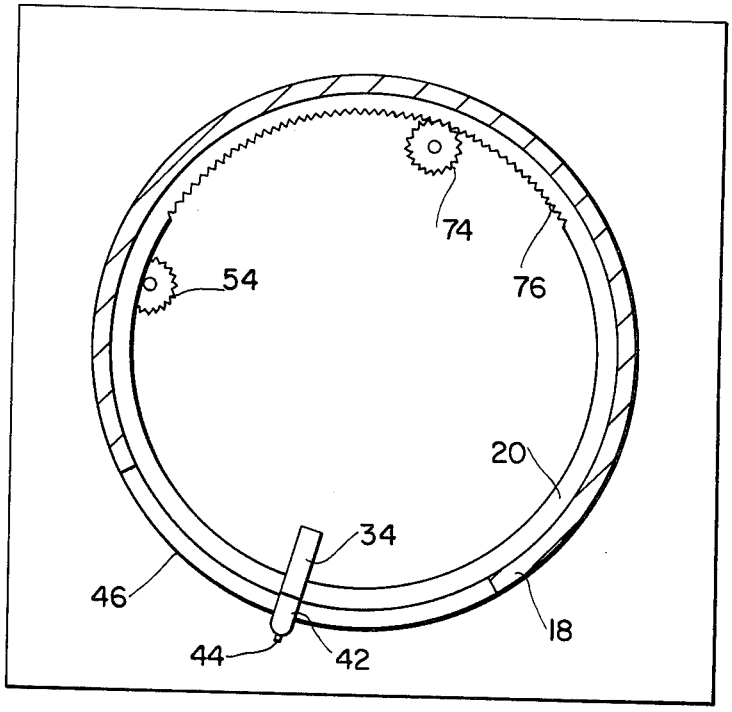
FIG. 3 shows a section of the apparatus taken on the line 3—3 of FIG. 2 looking in the direction of the arrows.

With reference to FIG. 3, which is a top plan view taken along the section line 3—3 of FIG. 2, the operation of the inner cylinder drive motor 70 can be more clearly understood. Specifically, the inner cylinder drive motor pinion 74 is shown in operable engagement with an internally toothed quadrant gear 76 mounted on the inside of inner cylinder 20. Rotation then of drive pinion 74 causes a relative rotation of inner cylinder 20 with respect to outer cylinder 18.

Figure 4:
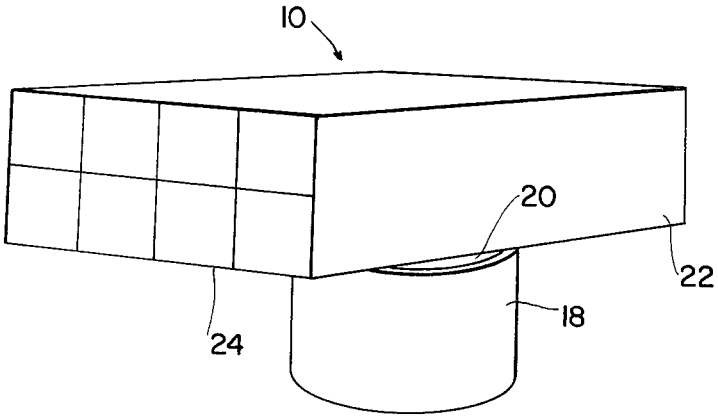
FIG. 4 is a perspective view of the present invention shown in the load position.

In operation, the general purpose decoy launcher 10 would initially be in a load position as illustrated in FIG. 4. In this position, the launch platform 22 would be aligned in a fore and aft position with respect to the ship 14. The launcher 10 would normally be manually loaded with decoy rounds 26, the same being inserted into the decoy launching tubes 24. At this stage of the operation, outer cylinder 18 would normally be in a locked position, having been priorly adjusted to its desired location by means of electric drive motor 50. After the insertion of the decoy rounds 26 into the launching tubes 24, the inner cylinder electric motor 70 is activated to rotate inner cylinder 20 with respect to outer cylinder 18. Such rotation is accomplished by drive pinion 74 engaging quadrant gear 76.

Figure 5:
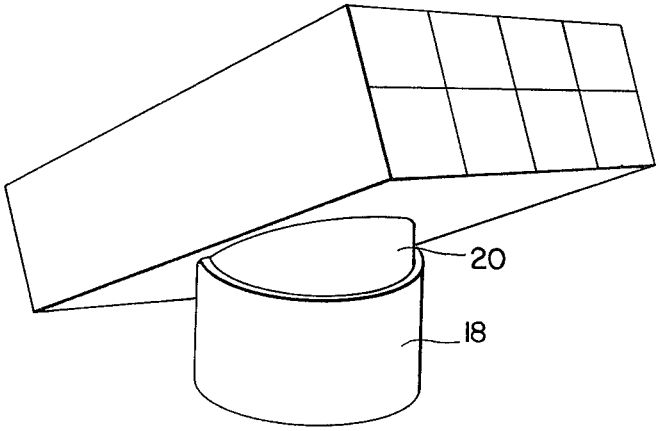
FIG. 5 is a perspective view of the launcher shown in the fire position.

As can be understood by reference to FIGS. 2 and 3, the rotation of inner cylinder 20 relative to outer cylinder 18 causes cam follower 42 to travel along inclined elevation ramp 46. The travel of follower 42, which is fixably attached to elevating strut 34, causes strut 34 to slide within strut slot 32. along the entire length of internally toothed quadrant gear 76, the launch platform 22 is effectively rotated by 90° to a fire position as depicted in FIG. 5. At the same time the elevating strut 34 is forcing the launch platform 22 to rock back upon the inclined surface 78 of inner cylinder 20. Depending upon the incline of the elevation ramp 46, the strut 34 operates to elevate the launch platform 22 to some firing angle at the same time that inner cylinder 20 rotates the launch platform 22 into a fire position outboard of the ship. Typically, the launch platform 22 will be elevated to an angle of 20°; however, it should be recognized that the launch elevation angle is variable as is the amount of rotation of inner cylinder 20 with respect to outer cylinder 18. For example, the quadrant gear 76 might be extended to include a 180° rotation capability of cylinder 20, the only requirement being that elevation ramp 46 also be lengthened. The train and elevation of the launch platform 22 would of course be centrally controlled by the ship's DTP console computer 80. Computer 80 is standard equipment on military ships and is conventionally utilized to train and elevate most of a ship's weaponry, e.g., missiles, cannons, etc.

While the embodiment thus described is operable by electric drive means, it is just as feasible to load and fire the decoy launcher 10 manually. In fact, it is expected that a manual override system would be provided with the embodiment of FIG. 2 so that in the event of electric or computer failure, the decoy launcher could still be utilized.

Various modifications are contemplated and may obviously be resorted to by those skilled in the art without departing from the spirit and scope of the invention, as hereinafter defined by the appended claims, as only a preferred embodiment thereof has been disclosed.

What is claimed and desired to be secured by Letters Patent of the United States is:

1. A launcher for decoys constructed for transportation and storage as a complete unit said launcher comprising in combination, a decoy transportation and launching platform, said launching platform being elevated by means associated with two concentric cylinders, said cylinders comprising one inner cylinder and one outer cylinder, said associated elevation means being actuated in response to relative rotation of the said cylinders, the outer cylinder being mounted on a suitable bearing surface, suitable drive means to rotate each cylinder and cam means located in the wall of the outer cylinder.

2. The launcher of claim 1 wherein the drive means to rotate the inner cylinder is an electric motor controlled by a computer.

3. The launcher of claim 1 wherein the drive means to rotate the outer cylinder is an electric motor controlled by a computer.

4. The launcher of claim 1 wherein the an upper portion of the inner cylinder is an inclined surface that accommodates the rearward portion of the launching platform when the platform is in the elevated position.

5. The launcher of claim 1 further characterized by independent drive means to rotate said inner cylinder and independent drive means to drive said outer cylinder.

6. The launcher of claim 5 wherein said cam means comprises in combination a cam follower shaft, a cam follower operatively engaging a cam positioned in the wall of said outer cylinder.

7. The launcher of claim 1 wherein said associated elevation means comprises an elevation strut and said outer cylinder has a cam opening through the wall thereof.

8. The launcher of claim 7 wherein the cam opening comprises an inclined elevation ramp that is capable of accommodating a cam follower.

9. The launcher of claim 1 wherein the associated elevation means comprises an outer cylinder fitted with an internal toothed gear that is engaged by a pinion gear mounted on a drive shaft.

10. The launcher of claim 9 wherein the drive shaft is driven by electric motor means.

11. The launcher of claim 10 wherein the electric motor means is controlled by a computer.

12. The launcher of claim 1 wherein the said outer cylinder is fitted with an internal toothed gear that is engaged by a pinion gear mounted on a drive shaft.

13. The launcher of claim 12 wherein the drive shaft is driven by electric motor means.

14. The launcher of claim 13 wherein the electric motor means is controlled by a computer.

15. The launcher of claim 1, further characterized in that the associated elevation means comprises an elevation strut that is actuated by cam means driven by said outer cylinder, and said inner cylinder is pivotably attached to the launch platform.

16. The launcher of claim 15 wherein the elevation strut is fastened to the launching platform by hinge means.

17. The launcher of claim 15 wherein the elevation strut is slidably mounted in a slot in the wall of the inner cylinder.

18. The launcher of claim 17 further characterized in that a cam follower shaft is fixably mounted on the lower end of the said elevation strut.

* * * * *